United States Patent [19]

Honegger et al.

[11] Patent Number: 4,566,143

[45] Date of Patent: Jan. 28, 1986

[54] BRIDGING SYSTEM FOR EXPANSION GAPS

[75] Inventors: Heinz Honegger, Wil; Josef Ganz, Flaach, both of Switzerland

[73] Assignee: Honel Holding AG, Bulach, Switzerland

[21] Appl. No.: 679,731

[22] Filed: Dec. 10, 1984

[30] Foreign Application Priority Data

Dec. 9, 1983 [AT] Austria ..... 4292/83

[51] Int. Cl.[4] ..... E01D 19/06

[52] U.S. Cl. ..... 14/16.5; 404/52; 404/54; 404/58; 404/63; 52/573

[58] Field of Search ..... 14/16.5; 404/47, 49–52, 404/56–63, 67, 54; 52/396, 573

[56] References Cited

U.S. PATENT DOCUMENTS 3,904,304 9/1975 Honegger ..... 404/52 X

FOREIGN PATENT DOCUMENTS 312040 12/1973 Austria ..... 14/16.5
1162863 2/1964 Fed. Rep. of Germany ..... 14/16.5
2746490 4/1979 Fed. Rep. of Germany ..... 14/16.5
973879 10/1964 United Kingdom ..... 14/16.5

*Primary Examiner*—James A. Leppink
*Assistant Examiner*—John F. Letchford
*Attorney, Agent, or Firm*—Thomas W. Speckman

[57] ABSTRACT

The present invention provides a bridging system which serves to bridge expansion gaps, used in the roadbeds of major structures such as bridges or viaducts. The supporting portion of the system comprises bearers, the upper sides of which are level with the surface of the roadway. The bearers rest on crosspieces that are supported in such a manner as to be able to move, within recesses below the roadway. The secondary gaps between the bearers are sealed by means of elastic rubber strips. In order that any contraction or expansion of the structure is distributed evenly across the secondary gaps, the crosspieces are controlled by means of connecting rods. The ends of these connecting rods are articulated onto opposing edges of the gap. In contrast to conventional systems of this kind in which connecting rods are disposed beneath the crosspieces, in the present system, connecting rods pass through the crosspieces. To this end, a bearing with plastic bearing elements is incorporated in the crosspieces, which makes it possible for the corresponding connecting rod to move and to pivot within the crosspieces.

18 Claims, 18 Drawing Figures

Fig. 5
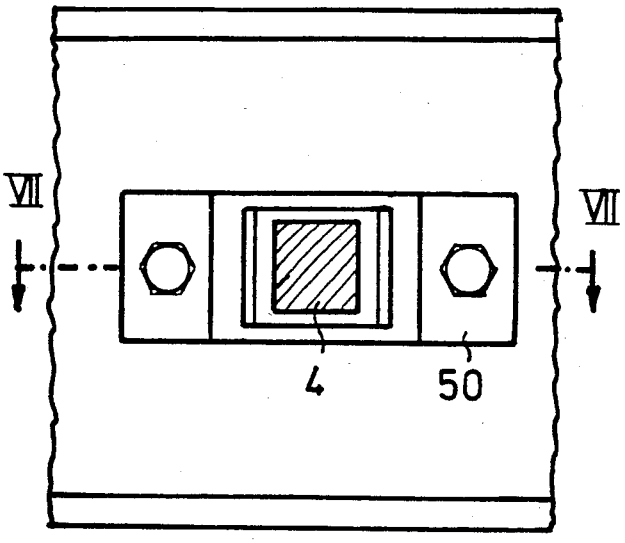
Fig. 6
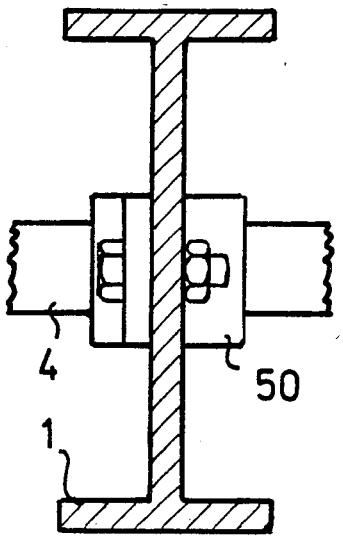
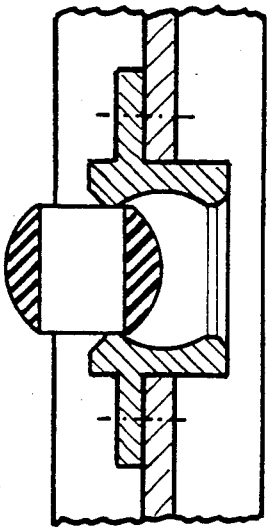
Fig. 8
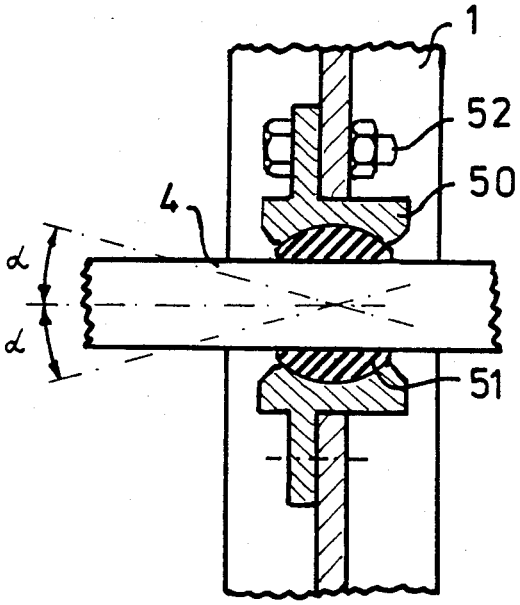
Fig. 7

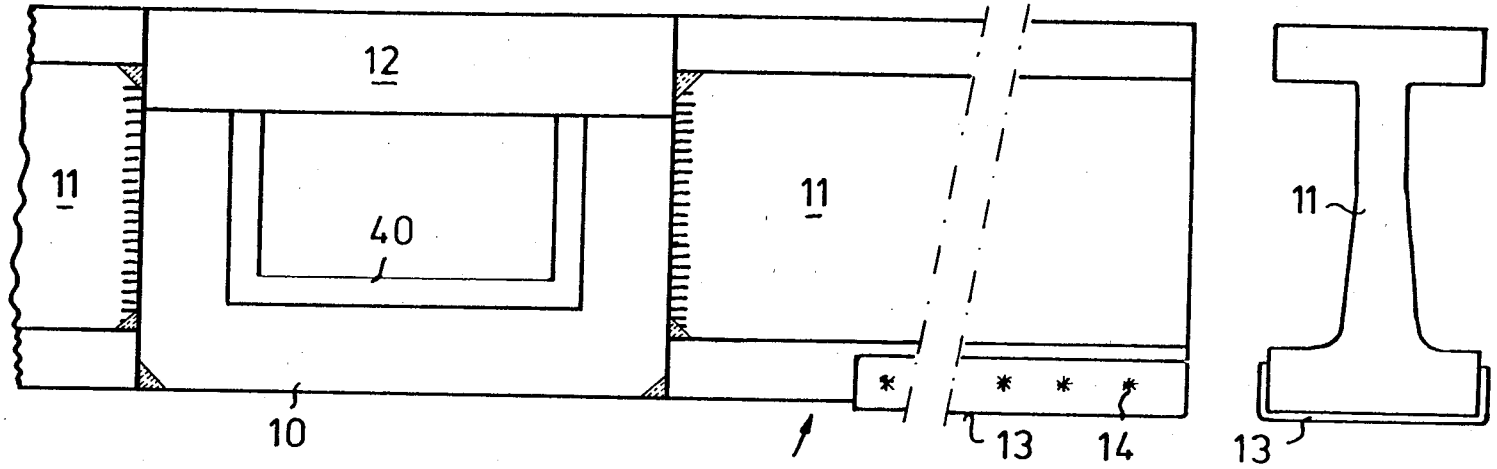
Fig.10
Fig.9
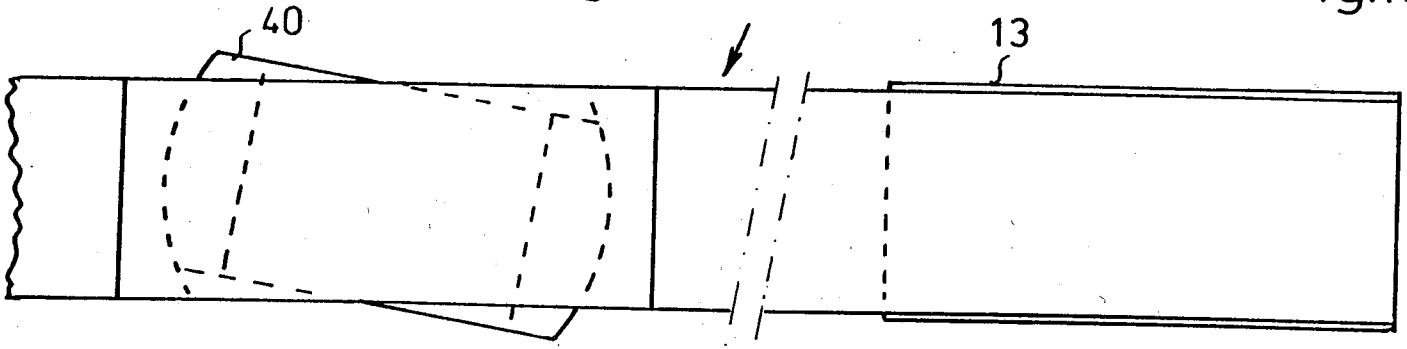
Fig.11

BRIDGING SYSTEM FOR EXPANSION GAPS

BACKGROUND OF THE INVENTION

1. Field of the Invention

The present invention relates to a bridging system for expansion gaps in the roadbed surfaces of bridges or the like. The device comprises elastic sealing strips that extend transversely to the longitudinal direction of the road surface, and are disposed in each instance between parallel bearers, the uppermost surfaces of which bearers are level with the surface of the road surface. Each of the bearers is connected to a crosspiece, the crosspieces being arranged in groups, and supported in a recess beneath the roadway on both sides of the expansion gap so as to be able to move longitudinally. The longitudinal movement of the crosspiece is effected by means of a connecting rod, the ends of which are retained on opposite sides of the expansion gap.

2. Description of the Prior Art

A bridging system for expansion gaps, which involves the so-called forced control of the crosspieces, is disclosed in Swiss Patent No. 494316. In this gap bridging system the connecting rod is disposed beneath the crosspieces. Each crosspiece is provided with a trunnion that extends downwardly and engages in a longitudinal groove in the connecting rod via an interposed sliding block. When the width of the gap changes as a result of expansion or contraction of the adjacent components, the connecting rod that is disposed deep beneath the surface of the road has to move the crosspieces with the bearers that are lying upon them and which extend upwards as far as the surface of the road. In addition, when traffic that is passing over the gap bridging system either accelerates or brakes, forces will be transmitted to the bearers and from there to the crosspieces, the trunnions and the sliding blocks within the grooves to the connecting rods. Transmission of the forces that are occasioned by the moving traffic is thus effected through various support points with relatively long lever arms. The constant alternating effect of such forces leads to large amounts of wear at the support points. Worn supports and bearings generate a great deal of noise when the bridging system is driven over.

SUMMARY OF THE INVENTION

The present invention provides a positive control system for a gap bridging system of the type described above, in which transmission of force from the crosspieces to the connecting rods is effected through as few bearing components as possible and with the smallest possible lever arms.

According to the present invention, the connecting rod passes through the crosspieces in such a way that it can pivot and move in an axial direction.

The present invention provides a gap bridging system for expansion gaps in the roadbeds of bridges or the like, comprising elastic sealing strips extending transversely to the longitudinal direction of the roadway, each of the sealing strips being arranged between parallel bearers, the upper surfaces of which are level with the surface of the roadway and each of the bearers is connected to a crosspiece, the crosspieces arranged in groups, and supported in a manner to permit them to move longitudinally, in recesses located beneath the roadway on both sides of the gap, the movement of the crosspieces being effected by a connecting rod, the ends of which are secured to opposite sides of the gap, the connecting rod passing through the crosspieces in such a way that it can pivot and move axially.

BRIEF DESCRIPTION OF THE DRAWINGS

The present invention will be further illustrated by way of the accompanying drawings in which:

FIGS. 5–8 show various embodiments of the pivot bearing for passing the connecting rod through the crosspiece;

FIGS. 9–11 show side, front and top views, respectively, of a crosspiece;

DESCRIPTION OF THE PREFERRED EMBODIMENTS

Figure 1:
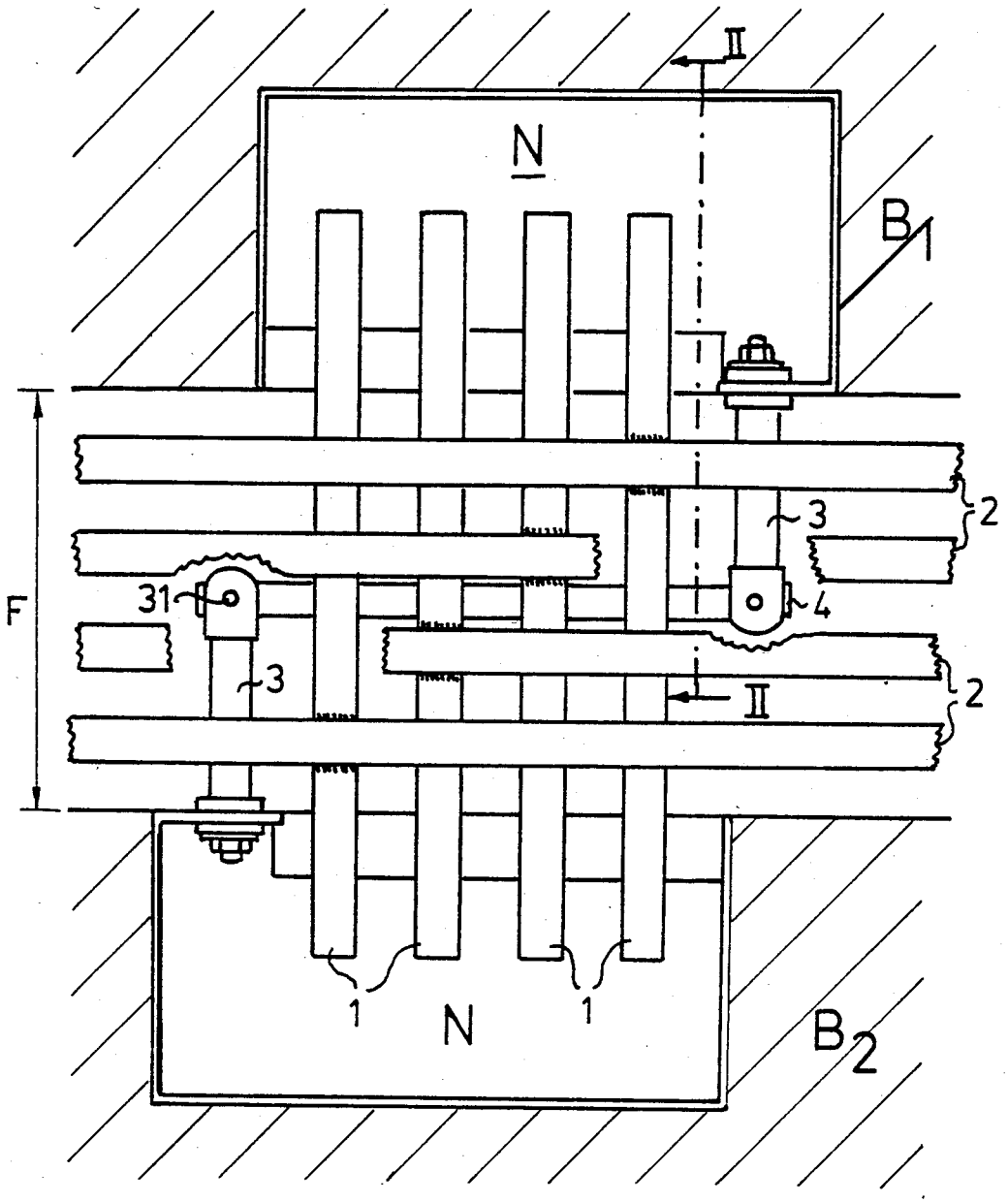
FIG. 1 is a simplified plan view of several crosspieces of a bridging system according to one embodiment of the present invention, the sealing strips between the bearers omitted.

Referring to the accompanying drawings, gap F, which may be varied as a function of the movements of components $B_1$, $B_2$, extends essentially perpendicular to the longitudinal direction of the roadway. The gap bridging system for the roadway is shown in a position corresponding to a central position between the maximum and minimum width of the gap. Along the entire length of the gap, groups of crosspieces 1 are arranged at specific intervals. The number of crosspieces 1 in each group corresponds to the number of bearers 2 that extend perpendicularly to crosspieces 1 and which extend along the longitudinal axis of the gap, passing across several groups of crosspieces 1. Each bearer 2 is connected rigidly to one of the crosspieces 1 associated therewith, preferably by welding. Crosspieces 1 that traverse gap F extend into recesses N on each side of the gap. The two end of connecting rod 4 are retained on opposite sides of the gap by struts 3. FIG. 1 shows the medium width expansion of the gap, at which connecting rod 4 extends along the longitudinal axis of the gap. If the gap becomes narrower as a result of the components expanding, or wider as a result of the components contracting, the connecting rod will pivot to ensure that the sub-gaps between bearers 2, which are bridged by elastic sealing strips, all grow wider or narrower by an equal amount.

Since the distance between trunnion 31, by which connecting rod 4 is connected to strut 3, and the edge of the gap has a fixed value, strut 3 must be pivotally secured to the edge of the gap, as will be explained hereinafter with reference to FIG. 4. Connecting rod 4 passes through all crosspieces 1 that comprise a group and is supported in crosspieces 1 in special bearings 40. Within recesses N crosspieces 1 are supported on bearing strips 6 which are preferably made of tetrafluoroethylene, and may be provided with lubricant traps. In each instance, each bearer 2 is rigidly connected to only one crosspiece 1 of the group, and passes over the remaining crosspieces of the group with some free play, as can be seen from FIG. 2. Bearings 40 permit connecting rod 4 to slide in an axial direction and to pivot. The presence of bearings 40 in the crosspieces allows the most favorable transfer of forces between connecting rod 4 and crosspieces 1.

Figure 2:
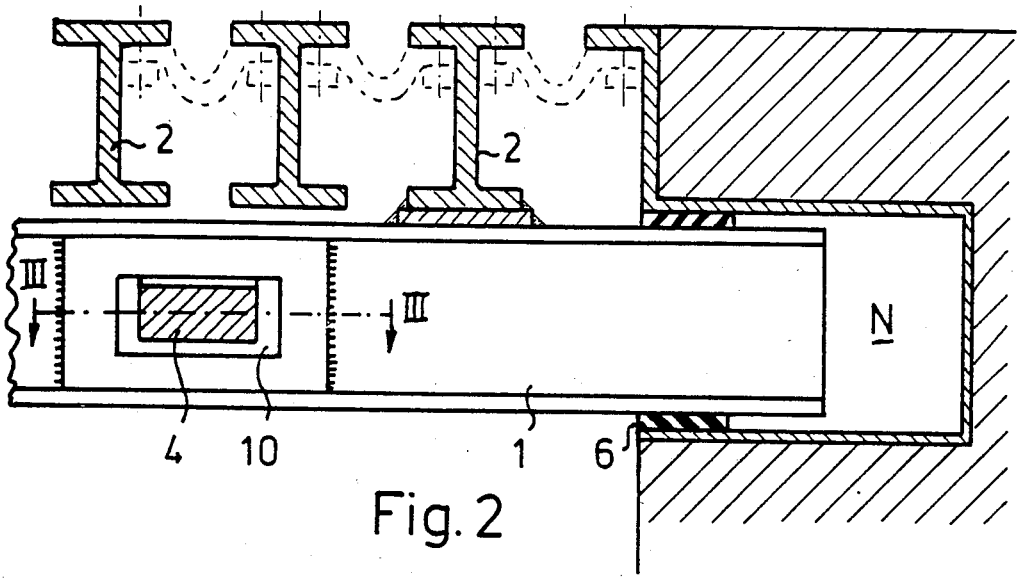
FIG. 2 is a cross-sectional view on an enlarged scale taken along the line II—II in FIG. 1.
Figure 3A:
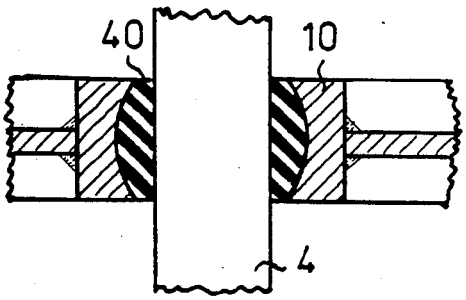
FIGS. 3*a* and 3*b* are cross-sectional views taken along line III—III in FIG. 2.
Figure 3B:
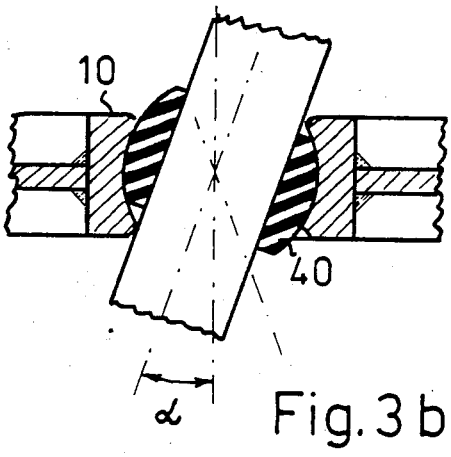

FIGS. 2 and 3 show crosspiece 1 in the form of an I beam, in the web of which, at about half its height, bearing housing 10 is present, which housing 10 is machined to be internally cylindrically concave. Bearing 40 is present within housing 10 and has a cylindrical exterior and a continuous drilled passage perpendicular to the axis of the cylinder which matches the cross section of connecting rod 4. Bearing 40 is preferably made of a plastic that has a low coefficient of friction, for example, polytetrafluoroethylene. It may be of one-piece construction or may be made from sections. Bearing housing 10 is welded into the web of crosspiece 1. This permits bilateral pivoting of connecting rod 4 through an angle $\alpha$.

Figure 4:
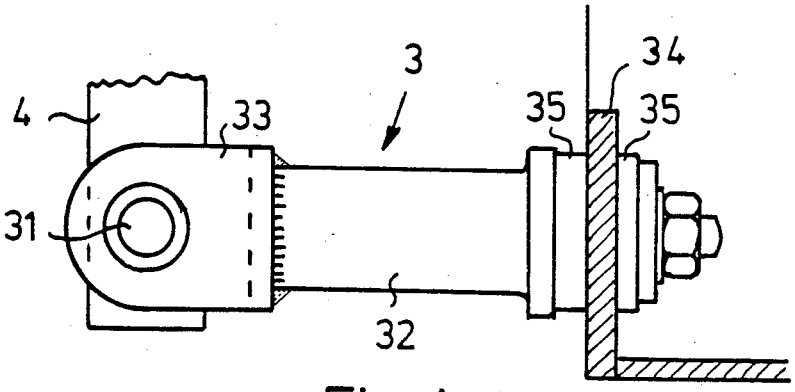
FIG. 4 is an enlarged plan view of a strut.
Figure 12:
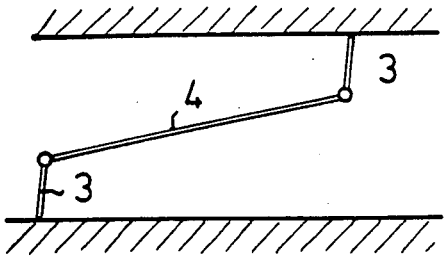
FIGS. 12–15 show schematic representations of various embodiments of struts with connecting rods.
Figure 13:
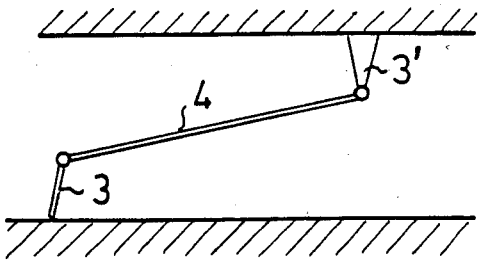
Figure 14:
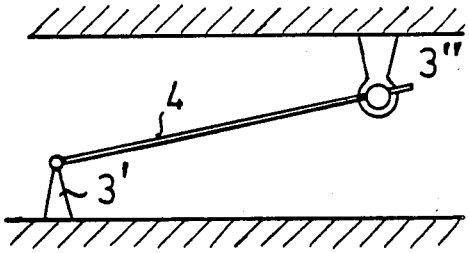
Figure 15:
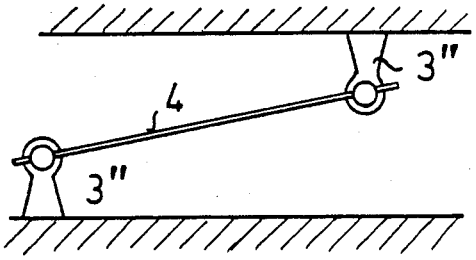

FIG. 4 shows strut 3 on an enlarged scale. The center portion 32 comprises a massive rod, a hollow structure, or a profiled bar, the end of which is welded to U-shaped tab 33 which, together with pivot pin 31, makes the connection with one end of connecting rod 4. As has already been stated, as the width of gap F changes, the longitudinal axis of connecting rod 4 becomes oblique to the longitudinal axis of the gap. In order to facilitate this movement, the strut is mounted so as to be able to pivot on tab 34 in recess chamber N. Two rubber discs 35 may be provided which permit strut 3 to move through a few degrees. Instead of both struts being so structured, one strut 3 may be rigid. The other strut 3 may then be elastically mounted, or may be rigid and provided with the same sort of bearing 40 as crosspieces 1 in which connecting rod 4 is secured, but able to pivot and move longitudinally. Modifications are shown schematically in FIGS. 12–15. FIG. 12 shows two pivotable struts 3 with connecting rod 4 connected to their ends. FIG. 13 shows one strut 3' attached at an edge of the gap rigidly at one end and one pivotable strut 3 at the other. In this case, deflection of strut 3 will be correspondingly greater. FIG. 14 shows a further modification with two struts 3' and 3'' rigidly connected to the edges of the gap. Connecting rod 4 is pivotally secured to strut 3' and pivotally secured to strut 3'' so that it may additionally move axially. FIG. 15 shows two rigid struts 3'' in which connecting rod 4 is pivotally secured at both ends so as to be able to move axially. Care must of course be taken to ensure that connecting rod 4 does not slip out of bearings 40.

FIGS. 5–8 show modifications of the crosspiece bearing. If the crosspieces are longer, the bearing for connecting rod 4 need not be welded into position, but can be screwed to strut 3. FIG. 5 shows bearing 50 of this type, viewed from the front, FIG. 6 viewed from the side, and FIG. 7 along section line VII—VII of FIG. 5, crosspiece 1 being in cross section. Plastic bearing 51 is similar to bearing 40 shown in FIG. 3.

This plastic bearing is easily installed or replaced when worn. For installation or replacement, connecting rod 4 is first removed from the bearing. Bearing shell 40 or 51 may be rotated through 90° and withdrawn from bearing housing 10 or 50, respectively, as shown in FIG. 8. The cross-sectional profile of the bearing shell is preferably U-shaped so that it can absorb both the lateral thrust and the pressure of connecting rod 4.

FIGS. 9–11 show a crosspiece 11 in greater detail. It includes U-shaped bearing shell 10 constructed of malleable cast iron turned to a cylindrical shape, welded between two sections 11 of I beam, and covered above by plate 12 which is welded into position. So that the ends of the crosspiece can slide easily on polytetrafluoroethylene strip 6 in recess N, polished stainless steel plate 13 is attached to the lower side of crosspiece 1. This plate is bent to form a U shape and secured to the sides of the flange by spot welds 14.

In earthquake zones in which constructional elements on either side of the gap may rise or fall, move sideways, or even twist, it may be advantageous to structure the crosspiece bearings so that they can accommodate such movements to a certain degree. For example, bearing shell 51 may be sperhical instead of cylindrical, and housing 50 may be a corresponding spherical shape. The sliding bearings in the recesses and struts must then be so structured that they too can conform to movements of the crosspieces.

Figure 16:
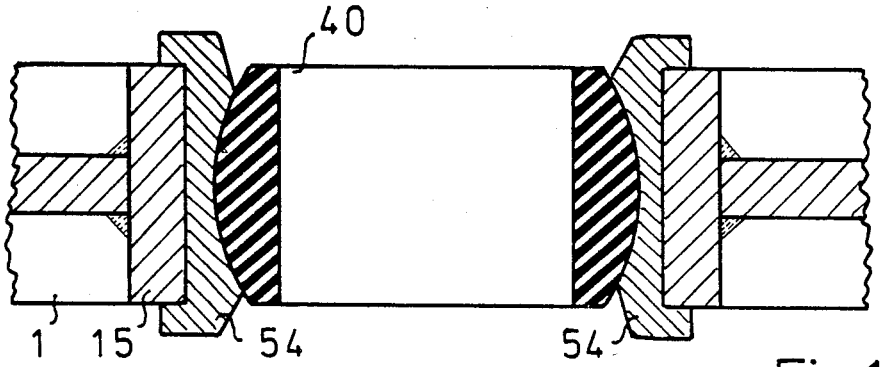
FIGS. 16 and 17 show an additional embodiment of a pivot bearing.
Figure 17:
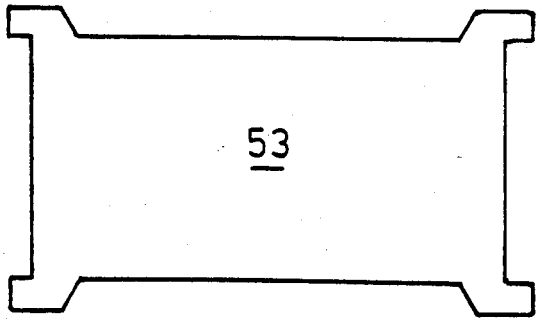

FIGS. 16 and 17 show a crosspiece bearing that is constructed in a similar way to the bearing of FIG. 3. The bearing housing comprises rectangular frame 15 welded to crosspiece 1, and this is precision machined after being welded in position. Base 53 (FIG. 17) is first installed on frame 15 and bearing components 54, machined as hollow cylinders, are then installed in the frame. This arrangement makes it possible to replace all the portions of the bearing that are susceptible to wear.

We claim:

1. A gap bridging system for expansion gaps in roadways comprising: elastic sealing strips extending transversely to the longitudinal direction of the roadway, each of said sealing strips being arranged between spaced parallel bearers, the upper surfaces of which are level with the surface of said roadway and each of which bearers is connected to a crosspiece, said crosspieces being arranged in groups and supported in a manner to permit them to move longitudinally in recesses located beneath the roadway on both sides of said gap, the movement of said crosspieces being effected by a connecting rod, the ends of which are secured to opposite sides of said gap, said connecting rod passing through said crosspieces and a bearing incorporated in each of said crosspieces supporting said connecting rod such that it can pivot and move axially.

2. A gap bridging system as in claim 1, in which both ends of said connecting rod on opposite edges of said gap are flexibly articulated onto flexibly mounted struts.

3. A gap bridging system as in claim 1, in which one end of said connecting rod is articulated onto a strut rigidly secured to one side of the gap, the other end of said connecting rod is articulated onto a pivotable strut on the opposite side of said gap.

4. A gap bridging system as in claim 1, in which each said bearing has a housing, said housing is internally spherical with open sides, said bearings have a spherical exterior and are pivotally mounted in said bore, and said bearings have a through bore slidably holding said connecting rod.

5. A gap bridging system as in claim 1, in which one end of said connecting rod is articulated onto a first strut rigidly secured to one side of the gap, the other end of said connecting rod being articulated so as to be able to move axially on a strut rigidly secured to the other side of said gap.

6. A gap bridging system as in claim 5, in which a bearing housing is present in said strut that is fixed rigidly to an edge of said gap, the interior of said bearing housing being cylindrically concave, in which two plastic bearing elements that are connected to each other via a support piece form a rotatable bearing having a cylindrical exterior and a through bore passage slidably holding said connecting rod.

7. A gap bridging system as in claim 1, in which each end of said connecting rod is attached in a pivotable and axially movable fashion to a strut rigidly secured to opposite sides of said gap.

8. A gap bridging system as in claim 4, in which a bearing housing is present in said strut that is fixed rigidly to an edge of said gap, the interior of said bearing housing being cylindrically concave, in which two plastic bearing elements that are connected to each other via a support piece form a rotatable bearing having a cylindrical exterior and a through bore passage slidably holding said connecting rod.

9. A gap bridging system as in claim 1, in which each said bearing has an essentially rectangular housing.

10. A gap bridging system as in claim 9, in which said bearing housings are internally lined with a plastic bearing.

11. A gap bridging system as in claim 10, in which said bearing housings are internally cylindrically concave, in which a pair of plastic bearing sections form a rotatable bearing having a cylindrical exterior and a through bore passage slidably holding said connecting rod.

12. A gap bridging system as in claim 11, in which said bearing housing is removably installed in said crosspiece.

13. A gap bridging system as in claim 1, in which each said bearing has an essentially rectangular metallic housing affixed to each said crosspiece.

14. A gap bridging system as in claim 13, in which said bearing housing is removably installed in said crosspiece.

15. A gap bridging system as in claim 13, in which each said metallic bearing housing is internally lined with a plastic bearing.

16. A gap bridging system as in claim 15, in which each said housing is internally a cylindrically concave bore with a vertical axis and open sides, said plastic bearings have a cylindrical exterior and are pivotally mounted in said bore, and said plastic bearings have a continuous cross passage slidably holding said connecting rod.

17. A gap bridging system as in claim 16, in which each said plastic bearing comprises two elements having a cylindrical exterior and connected to each other by a support piece to form a pivotable bearing lining in the bore of said housing.

18. A gap bridging system as in claim 15, in which said housing is internally spherical with open sides, said plastic bearings have a spherical exterior and are pivotally mounted in said bore, and said plastic bearings have a through bore slidably holding said connecting rod.

* * * * *